United States Patent [19]

Mizuno

[11] Patent Number: 4,905,561

[45] Date of Patent: Mar. 6, 1990

[54] AUTOMATIC ACCOMPANYING APPARATUS FOR AN ELECTRONIC MUSICAL INSTRUMENT

[75] Inventor: Kotaro Mizuno, Hamamatsu, Japan

[73] Assignee: Yamaha Corporation, Hamamatsu, Japan

[21] Appl. No.: 293,691

[22] Filed: Jan. 5, 1989

[30] Foreign Application Priority Data

Jan. 6, 1988 [JP] Japan ..... 63-268

[51] Int. Cl.[4] ..... G10H 1/38; G10H 1/42; G10H 7/00

[52] U.S. Cl. ..... 84/613; 84/DIG. 12; 84/DIG. 22

[58] Field of Search ..... 84/1.01, 1.03, 1.17, 84/1.24, 1.28, DIG. 12, DIG. 22

[56] References Cited

U.S. PATENT DOCUMENTS 4,704,933 11/1987 Kurakake .
4,719,834 1/1987 Hall et al. ..... 84/1.03

FOREIGN PATENT DOCUMENTS 59-140495 8/1984 Japan .

*Primary Examiner*—Stanley J. Witkowski
*Attorney, Agent, or Firm*—Spensley Horn Jubas & Lubitz

[57] ABSTRACT

A new automatic accompaniment apparatus for sequentially reading out at a predetermined tempo accompaniment pattern information, including interval shift information, stored in a pattern memory and then generating tones of a designated chord, designated by a chord designatin means such as a keyboard, based on the accompaniment pattern information, thereby performing an accompaniment performance. The new automatic accompaniment apparatus, when the interval shift information is read out, will play a chord which is constituted by shifting intervals of part or all of the constituting tones of the designated chord in place of the designated chord, thus enabling an accompaniment performance rich in variety to be played as compared with a conventional apparatus having a memory capacity equivalent to that of the present accompaniment apparatus.

3 Claims, 8 Drawing Sheets

| KEY | --- $C_1$ --- $C_2$ $C_2^{\#}$ --- $G_2$ --- $C_3$ --- $F_3^{\#}$ --- $C_4$ --- $C_5$ --- $C_6$ --- |
|---|---|
| KEY CODE | --- 36 --- 48 49 --- 55 --- 60 --- 66 --- 72 --- 84 --- 96 --- |

CHORD TONE GENERATION RANGE

| CHORD | TYPE | GRP |
|---|---|---|
| M | 0 | 0 |
| m | 1 | 1 |
| 7th | 2 | 2 |
| M7 | 3 | 0 |
| m7 | 4 | 2 |
| $m7^{-5}$ | 5 | 1 |
| 7sus4 | 6 | 2 |
| NOT ESTABLISHED | 7 | (0) |

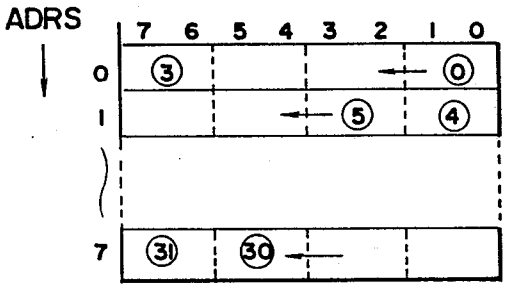
FIG. 5A
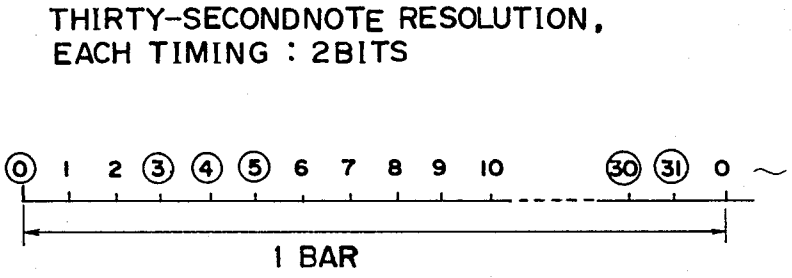
FIG. 5B
| | IMMEDIATELY PRECEDING TIMING | PRESENT TIMING |
|---|---|---|
| KEY-ON EVENT | 0 0 | EXCEPT 0 0 |
| KEY-OFF EVENT | EXCEPT 0 0 | 0 0 |
FIG. 5C

| RHYTHM | VAR | DETECTED CHORD GROUP | | | | | |
|---|---|---|---|---|---|---|---|
| | | M (0) | | m (1) | | 7th (2) | |
| | | ROOT | TYPE | ROOT | TYPE | ROOT | TYPE |
| DISCO | 2 | -1 | 0 | -1 | -1 | -1 | -2 |
| 16 BEAT | 1 | -1 | 0 | -1 | 0 | -1 | -2 |
| BIG BAND | 2 | -2 | 0 | -2 | -1 | -2 | -2 |
| SAMBA | 1 | -3 | +1 | -4 | -1 | 0 | -2 |
| ⋮ | ⋮ | ⋮ | ⋮ | ⋮ | ⋮ | ⋮ | ⋮ |
FIG. 6A
| RHYTHM | VAR | C | Cm | C7 |
|---|---|---|---|---|
| DISCO | 2 | $B^b$ | $B^b$ | $B^b$ |
| 16 BEAT | 1 | $B^b$ | $B^b_m$ | $B^b$ |
| BIG BAND | 2 | B | B | B |
| SAMBA | 1 | Am | $A^b$ | C |
| ⋮ | ⋮ | ⋮ | ⋮ | ⋮ |
FIG. 6B
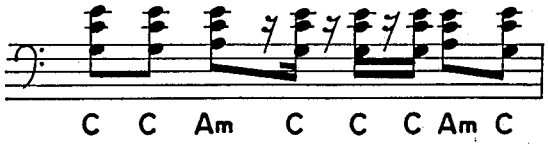
FIG. 7
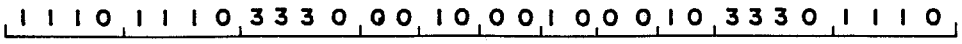
FIG. 8

| CHORD | TYPE | $KY_1$ | $KY_2$ | $KY_3$ | DEGREE OF TONE GENERATION | | |
|---|---|---|---|---|---|---|---|
| M | 0 | ROOT | ROOT + 4 | ROOT + 7 | 1° | 3° | 5° |
| m | 1 | ROOT | ROOT + 3 | ROOT + 7 | 1° | 3b° | 5° |
| 7th | 2 | ROOT | ROOT + 4 | ROOT + 10 | 1° | 3° | 7b° |
| M7 | 3 | ROOT | ROOT + 4 | ROOT + 11 | 1° | 3° | 7° |
| m7 | 4 | ROOT | ROOT + 3 | ROOT + 10 | 1° | 3b° | 7b° |
| $m7^{-5}$ | 5 | ROOT + 3 | ROOT + 6 | ROOT + 10 | 3b° | 5b° | 7b° |
| 7sus4 | 6 | ROOT + 5 | ROOT + 7 | ROOT + 10 | 4° | 5° | 7b° |
| NOT ESTABLISHED | 7 | HIGHEST TONE | SECOND HIGHEST TONE | THIRD HIGHEST TONE | – | – | – |

FIG. 12

AUTOMATIC ACCOMPANYING APPARATUS FOR AN ELECTRONIC MUSICAL INSTRUMENT

BACKGROUND OF THE INVENTION

The present invention relates to an automatic accompaniment apparatus for playing chords, designated by a chord designation means such as a keyboard, based on a chord performance pattern stored in a memory, and more particularly it relates to an automatic accompaniment apparatus which appropriately changes intervals of chords to achieve a varied accompaniment performance.

There has heretofore been known an automatic accompaniment apparatus of an electronic musical instrument, which designates a chord upon depression of keys on a keyboard and automatically generates tones of the designated a chord in accordance with a predetermined chord performance pattern to make an accompaniment performance, and sequentially generates bass tones having pitches determined based on the designated chord and tone generation timings to make a walking bass performance (e.g., Japanese Patent Laid-Open (Kokai) No. 59-140495).

In the conventional automatic accompaniment apparatus, generation of bass tones is controlled by note information and timing information, and that of a designated chord is controlled by only the timing information.

For this reason, in the conventional automatic accompaniment, identical chord tones are merely generated at identical pitches and at a predetermined rhythm, resulting in poor variation.

In order to vary the performance, note information (pitch information) may be stored like the bass tones. In this case, the volume of chord pattern information is undesirably increased. In particular, if polyphonic tones are stored, a capacity required for a chord pattern memory is increased.

SUMMARY OF THE INVENTION

The present invention has been made in consideration of the above conventional problems, and has as its object to provide an automatic accompanying apparatus for performing an automatic accompaniment based on chord designated by a chord designation means and an accompaniment pattern stored in a memory, which can achieve a varied performance, and can limit an increase in information volume (memory capacity) of the accompaniment pattern as much as possible.

In order to achieve the above object, according to the present invention, in an apparatus for performing an automatic accompaniment based on a chord designated by a chord designation means and an accompaniment pattern stored in a memory, interval shift information representing a manner in which intervals of chord-constituting tones are to be shifted is included in the accompaniment pattern, and intervals are converted based on the interval shift information according to a predetermined rule.

With the arrangement of the present invention, when an automatic accompaniment is performed based on a chord designated by a chord designation means and an accompaniment pattern stored in a memory, the intervals of the designated a chord are converted based on the interval shift information included in the accompaniment pattern and corresponding tones are generated.

According to the present invention, a varied accompaniment performance can be made unlike a conventional simple backing accompaniment performance. Only the interval shift information is added to the accompaniment pattern. As compared to a case wherein pitch information of accompaniment tones is stored in the accompaniment pattern, the storage capacity required for the accompaniment pattern can be greatly decreased.

BRIEF DESCRIPTION OF THE DRAWINGS

FIGS. 5A to 5C show chord pattern data formats of the pattern memory shown in FIG. 1;

FIGS. 6A and 6B show chord conversion tables;

FIG. 7 shows a music sheet showing a backing pattern automatically accompanied by the electronic musical instrument shown in FIG. 1;

FIG. 8 is a view showing a chord data pattern for automatically playing the backing pattern of the music sheet shown in FIG. 7;

FIG. 12 shows a chord tone generation rule table used in the chord tone generation processing shown in FIG. 11.

DETAILED DESCRIPTION OF THE PREFERRED EMBODIMENT

An embodiment of the present invention will now be described with reference to the accompanying drawings.

Figure 1:
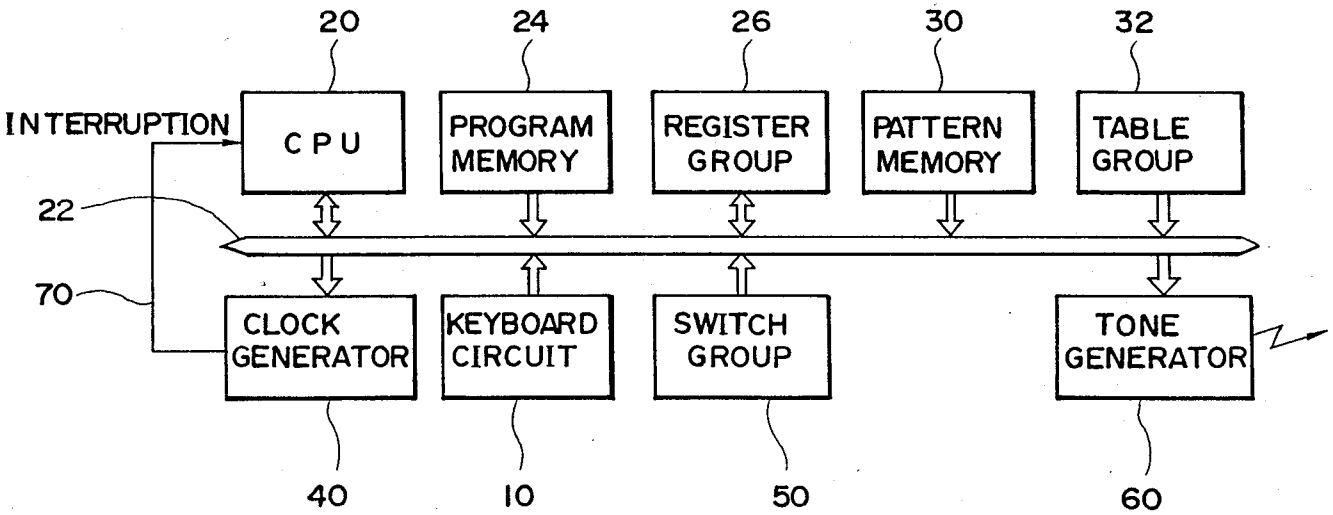
FIG. 1 is a block diagram showing a hardware arrangement of an electronic musical instrument according to an embodiment of the present invention.

FIG. 1 shows a hardware arrangement of an electronic musical instrument to which an automatic accompanying apparatus according to an embodiment of the present invention is applied.

(Description of Arrangement of Electronic Musical Instrument in FIG. 1)

Figures 2, 3, 4:
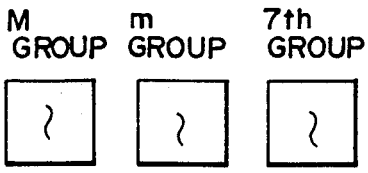
FIG. 2 is a table showing a correspondence between keys and key codes in a keyboard circuit shown in FIG. 1.
FIG. 3 is a table showing a correspondence among chord types, chord groups, and their numerical value data in the electronic musical instrument shown in FIG. 1.
FIG. 4 shows an accompaniment pattern format of a pattern memory shown in FIG. 1.

In FIG. 1, a keyboard circuit 10 detects depression of a key at a keyboard (not shown), and generates key information (key code) representing the depressed key. The key code complies with the MIDI (Musical Instrument Digital Interface) standards. As shown in FIG. 2, the key codes are obtained by assigning integer multiples of 12 (indicated by decimal notation), e.g., 36, 48, . . . , 96 to respective C tones, and values, which are incremented by one as a tone sharps, to the remaining keys in correspondence with positions $C_1$, $C\#_1$, $D_1$, . . . , $B_1$, $C_2$, . . . , $C_6$ of depressed keys. A rest, i.e., a (key) code representing a state wherein none of the keys is depressed is represented by "0". In the following description, the numerical value data such as key codes are indicated by the decimal notation unless otherwise specified.

The overall operation of the electronic musical instrument shown in FIG. 1 is controlled by using a central processing unit (CPU) 20. The CPU 20 is connected to the keyboard circuit 10, a program memory 24, a register group 26, a pattern memory 30, a table group 32, a clock generator 40, a switch group 50, and a tone generator 60 through a bidirectional bus line 22. The tone generator 60 is connected to a sound system consisting of an amplifier, loudspeakers, and the like although not shown. The clock pulse output terminal of the clock generator 40 is connected to the interrupt signal input terminal of the CPU 20 through a signal line 70.

Figure 9:
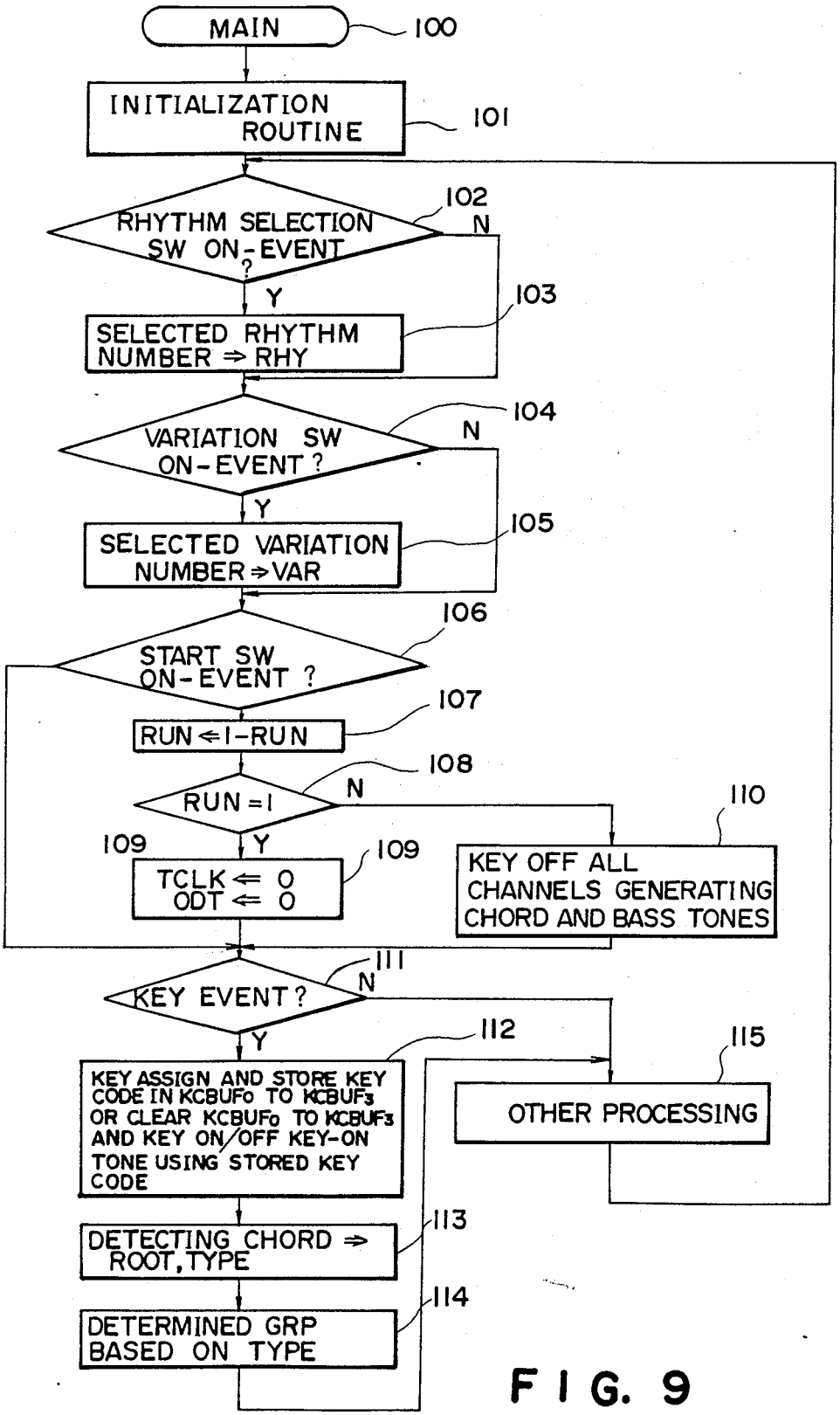
FIG. 9 is a flow chart of main processing of the electronic musical instrument shown in FIG. 1.
Figure 10:
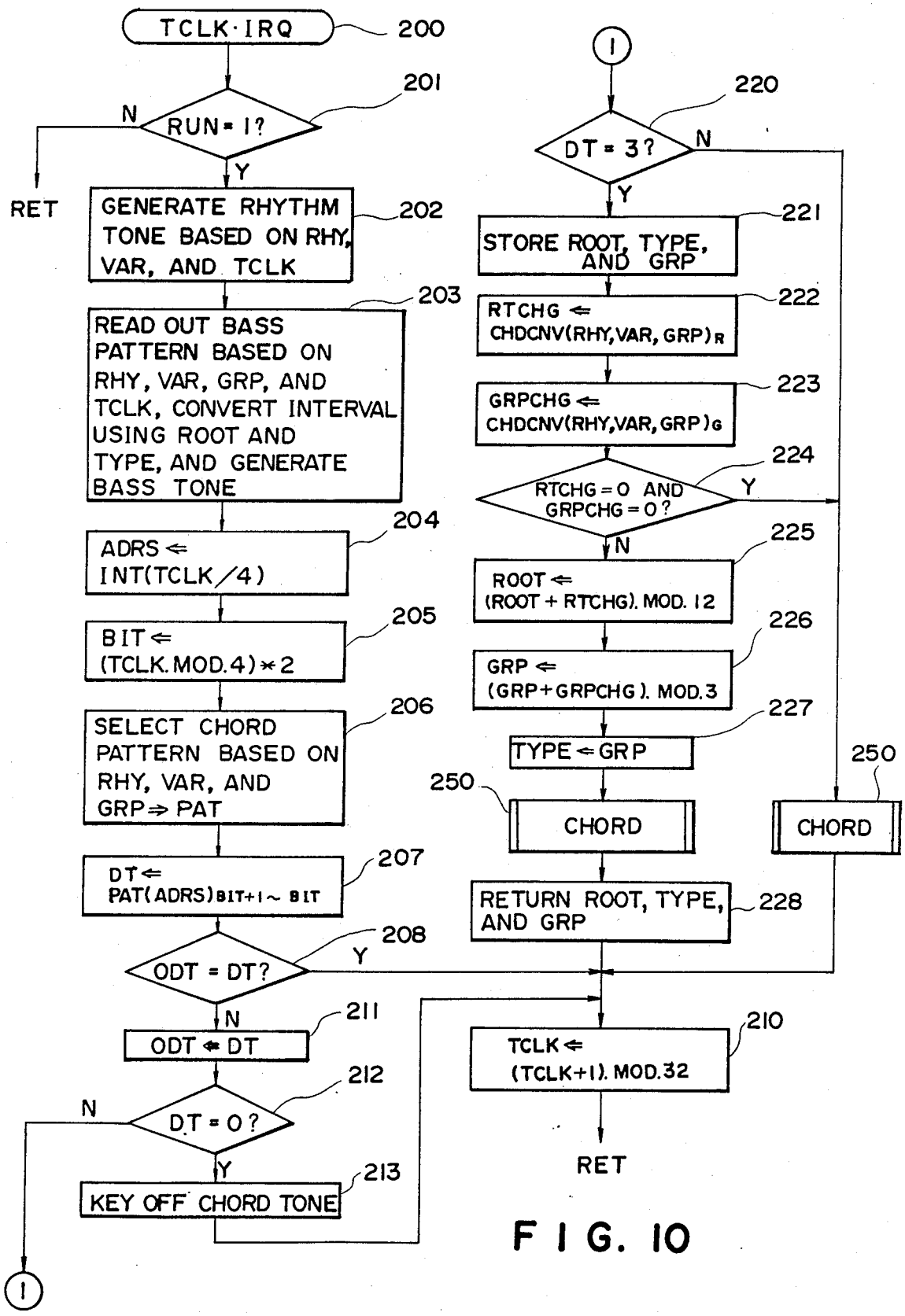
FIG. 10 is a flow chart of tempo clock interruption processing of the electronic musical instrument shown in FIG. 1.
Figure 11:
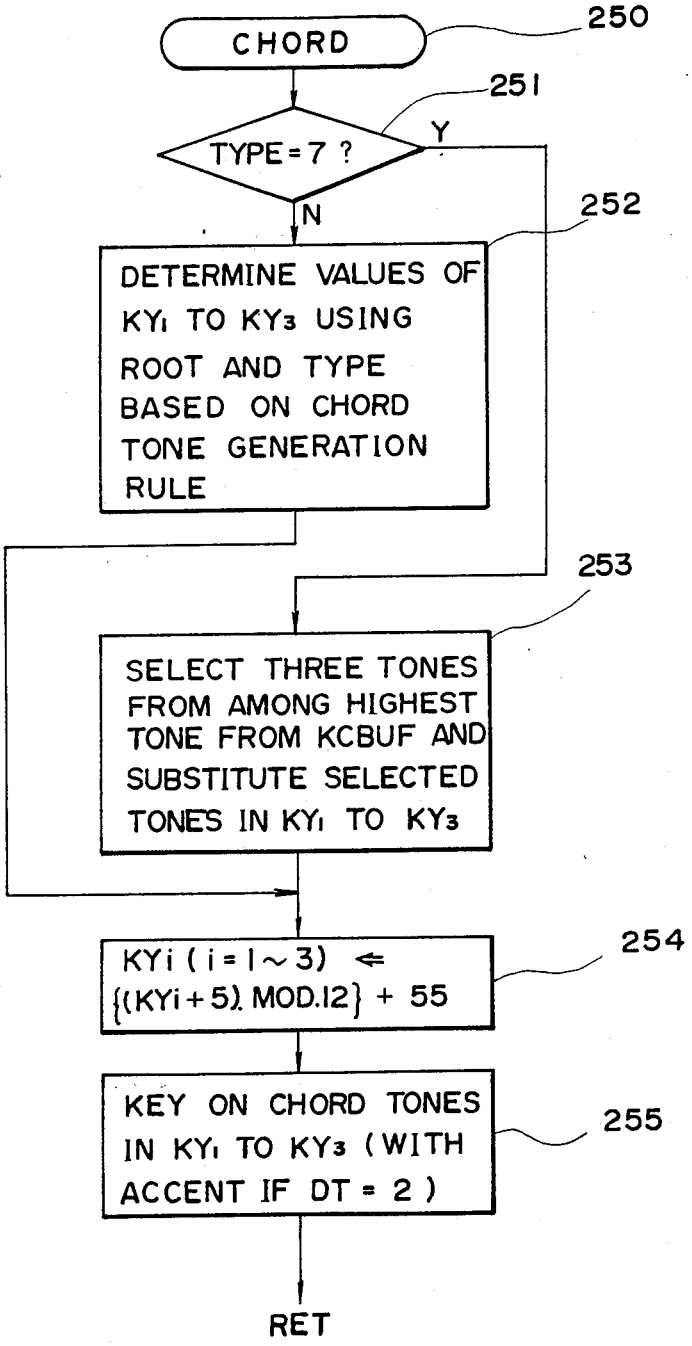
FIG. 11 is a flow chart of chord tone generation processing of the electronic musical instrument shown in FIG. 1.

The program memory 24 comprises a ROM, and stores various control programs of main processing, tempo clock interruption processing, chord tone generation processing, and the like corresponding to the flow charts shown in FIGS. 9 to 11.

The register group 26 temporarily stores various data generated when the CPU 20 executes the control programs, and includes the following registers set in a RAM. In the following description, the registers and their contents (data or the like) are represented by identical label names unless otherwise specified.

TCLK: tempo clock

TCLK indicates a progression position of an auto rhythm within one measure and varies in the range of 0 to 31.

RUN: rhythm run flag

RUN indicates whether a rhythm runs (=1) or is stopped (=0).

RHY: rhythm number

RHY represents a type of rhythm.

VAR: rhythm variation number

VAR represents a variation pattern number of a rhythm designated by the rhythm number RHY, where "0" represents a normal pattern.

$KCBUF_0$ to $KCBUF_3$: key code buffers for depressed keys

ROOT: root of a chord

Note codes of C, C#, D, . . . , B are represented by values "1" to "11".

TYPE: chord type

As shown in FIG. 3, chord types are represented by values "0" to "6". "7" represents that a chord cannot be formed.

GRP: chord group

Three groups, e.g., an M (major) group, an m (minor) group, and a 7th (seventh) group are represented by "0" to "2", respectively.

ADRS: address pointer of chord pattern

ADRS is incremented every four tempo clocks TCLK

BIT: bit pointer of chord pattern

BIT indicates a position of chord pattern data with respect to the present timing in one byte. One tempo clock TCLK allows an increment of 2 bits.

DT: chord pattern data

DT is 2-bit data, "00" indicates a rest, "01" indicates a key-on event, "10" indicates a key-on event with an accent, and "11" indicates an interval shift key-on event.

ODT: old chord pattern data

ODT represents a chord pattern data value at an immediately preceding timing.

RTCHG: root shift amount data

RTCHG represents a value of a chord conversion table (FIGS. 6A–6B).

GRPCHG: group shift data

GRPCHG represents a value of a chord conversion table (FIGS. 6A–6B).

$KY_1$ to $KY_3$: chord tone key code registers $KY_1$ to $KY_3$ temporarily store tones (three tones) constituting a chord for generating accompanying tones.

PAT: chord pattern number register

The pattern memory 30 comprises a ROM, and stores rhythm patterns, chord patterns, and bass patterns. As the rhythm patterns, a plurality of variation patterns are prepared in correspondence with rhythm variation numbers VAR in units of rhythm types corresponding to rhythm numbers RHY. The memory 30 stores (the number of rhythm types)×(the number of variation patterns) rhythm patterns. The memory 30 stores three types (the M (major), m (minor), and 7th groups) in FIG. 4 of each of chord and bass patterns for each rhythm pattern, i.e., the chord and bass patterns three times the rhythm patterns.

Each chord pattern is obtained by arranging one-measure 2-bit chord pattern data each representing a tone generation state at a timing corresponding to a thirty-second note in the order starting from the lowest address ADRS and the least significant bit BIT, as shown in FIG. 5A. This chord pattern is recorded at a thirty-second note resolution. FIG. 5A shows encircled typical timings (in FIG. 5B) in a state wherein chord pattern data at timings "0" to "31" of one measure in quadruple time are arranged in the pattern memory 30. For each 2-bit chord pattern data, "0" represents a rest; "1", a key-on event; "2", a key-on event with an accent; and "3", an interval shift key-on event.

The memory 30 stores note (or pitch) data of bass patterns in C major.

In the table group 32, a chord conversion table shown in FIG. 6A is prepared. The chord conversion table represents how to shift an interval of each constituting tone of a chord designated upon depression of a key of the keyboard circuit 10 (to be referred to as a designated chord hereinafter) when data "11" (binary notation) representing the interval shift key-on event is read out as the chord pattern data. The shift amount of the designated chord is determined as follows with reference to the chord conversion table upon interval shift:

$CHDCNV(RHY,VAR,GRP)_R$

→shift amount of root conversion $CHDCNV(RHY,VAR,GRP)_G$

→shift amount of chord group conversion

FIG. 6B exemplifies a chord conversion in C. For example, if a rhythm pattern is first variation pattern ($samba_1$) of samba and the designated chord is in C major (root: 0, type: 0), "3" is subtracted from the root to yield "A" (=−3), and "1" is added to the type to yield "minor" (=1). Thus, the chord to be accompanied is converted to "Am". Therefore, when the "$samba_1$" rhythm pattern is selected and keys of C major are depressed to perform an automatic accompaniment using pattern data shown in FIG. 8, a backing pattern shown in FIG. 7 is played. In this case, a chord tone generation range is limited to one octave tone range starting from $G_2$. Since all the constituting tones of both the designated chords and the converted chords are set within the range of $G_2$ to $F\#_3$, a natural chord performance can be made without using notes having a large pitch difference. In the above case, the notes of chord C are $C_3$, $E_3$, and $G_3$, and the notes of chord Am are $A_2$, $C_2$, and $E_3$. Thus, only $G_3$ is replaced with $A_2$ in these chords.

The tempo clock generator 40 is obtained by combining a variable frequency oscillator or fixed-frequency oscillator and a frequency divider having a variable frequency division ratio, and 32 clock pulses per measure in quadruple time are generated in accordance with a preset tempo. These clock pulses are input to the CPU 20 through the signal line 70 as an interruption signal.

The switch group 50 includes various operation switches arranged on an operation panel (not shown), e.g., a start/stop switch for designating start and stop of automatic rhythm and accompaniment performance operations, a rhythm selection switch, a variation pattern selection switch, and the like.

The tone generator 60 has four tone formation channels for forming key-on tones, three channels for forming chord tones, and one channel for forming a bass tone. The tone generator 60 forms a tone signal based on key-on data, key-off data, tone color (or instrument type) data, pitch data, and the like, and supplies the signal to a sound system (not shown) comprising an amplifier and the like. The sound system generates tones based on the tone signal.

(Description of Operation of Electronic Musical Instrument shown in FIG. 1)

The operation of the electronic musical instrument shown in FIG. 1 will be described below with reference to the flow charts shown in FIGS. 9 to 11.

When the electronic musical instrument is powered, the CPU 20 starts an operation in accordance with the control program stored in the program memory 24. First, the CPU 20 executes processing of a main routine in step 100 and thereafter in FIG. 9, and also executes tempo clock interruption processing shown in FIG. 10.

1. Main Routine Processing

Referring to FIG. 9, the CPU 20 performs initialization processing in step 101. The initialization processing includes setting of the rhythm run flag RUN, clearing of the key code buffers $KCBUF_0$ to $KCBUF_3$, and zero-clearing of the rhythm number register RHY, the rhythm variation register VAR, and the like. The CPU 20 then executes loop processing consisting of steps 102 to 115.

In this loop processing, the outputs from the switch group 50 are checked in steps 102, 104, and 106. If the CPU 20 detects an on-event of the rhythm selection switch, i.e., that the state of the switch is switched from OFF to ON, the flow branches to step 103. In step 103, the selected rhythm number is stored in the register RHY, and thereafter, the flow advances to step 104. If the CPU 20 does not detect an on-event in step 102, the flow directly advances from step 102 to step 104 while skipping the processing in step 103. If the CPU 20 detects the on-event of the variation switch in step 104, the flow advances to step 105, and the selected variation number is stored in the register VAR. Thereafter, the flow advances to step 106. On the other hand, if no on-event is detected in step 104, the flow directly advances from step 104 to step 106. If the CPU 20 determines the on-event of the start/stop switch in step 106, the flow branches to step 107. In step 107, the rhythm run flag RUN is inverted, and thereafter, the CPU 20 checks in step 108 if the flag RUN becomes "1" (or is set). If the flag RUN is set, the tempo clock register TCLK and the old data register ODT are cleared in step 109 in order to start automatic rhythm and accompaniment performance operations, and then, the flow advances to step 111. On the other hand, if the flag RUN is reset, the CPU 20 supplies an all key-off instruction of channels which are generating chord and bass tones to the tone generator 60 in step 110 so as to stop automatic chord and bass performance operations. The flow then advances to step 111. If no switch on-event is detected in step 106, the flow directly advances from step 106 to step 111 without executing the processing in steps 107 to 110.

In step 111, the CPU 20 checks the output from the keyboard circuit 10 to determine the presence/absence of a key event. If no key event is detected, the flow directly advances from step 111 to step 115; otherwise, the flow advances to step 112. In step 112, if the detected key event is a key-on event, the event is key-assigned and stored in one of the registers $KCBUF_0$ to $KCBUF_3$. Alternatively, if the detected key event is a key-off event, the corresponding one of the registers $KCBUF_0$ to $KCBUF_3$ is cleared in step 112. In step 113, the CPU 20 detects a chord represented by the key depression states stored in the registers $KCBUF_0$ to $KCBUF_3$, and stores root data in the register ROOT and a chord type in the register TYPE. In step 114, the CPU 20 determines a chord group (FIG. 3) to which the detected chord belongs based on the data in the register TYPE. The flow then advances to step 115.

In step 115, other processing is executed. The flow then returns to step 102, and the loop processing in steps 102 to 115 is repeated.

2. Clock Interruption Processing

In this electronic musical instrument, the CPU 20 executes the clock interruption processing shown in FIG. 10 in response to a tempo clock generated by the tempo clock generator 40 for every 1/32 cycle of one measure in quadruple time as an interruption signal.

Referring to FIG. 10, the CPU 20 checks the rhythm run flag RUN in step 201. If the flag RUN is "0", the rhythm and accompaniment automatic performance operations are interrupted, and the tone generation processing of rhythm and accompaniment tones, count processing of the tempo clocks, and the like need not be performed. Therefore, interruption is immediately canceled, and the control recovers the main routine.

If the flag RUN is "1", since the rhythm and accompaniment automatic performance operations are running, the CPU 20 executes rhythm tone generation processing based on the rhythm number RHY, the variation number VAR, and the tempo clock TCLK in step 202. In step 203, the CPU 20 executes bass tone generation processing. In this processing, the bass pattern is read out based on the rhythm number RHY, the variation number VAR, the chord group GRP, and the tempo clock TCLK, the intervals are converted based on the root ROOT and chord type TYPE, key-on/key-off data of the bass tone is supplied to the tone generator 40, and so on.

In this case, bass pitch (note) data read out as the bass pattern is interval-converted to generate a bass tone due to the following reason. That is, since the bass pattern is stored in the pattern memory 30 in C major notes, the readout bass pitch data must be harmonized with the constituting tones (notes) of the designated chord.

In step 204, an integer part of a quotient obtained by dividing the tempo clock TCLK by 4 is stored in the address pointer ADRS, and in step 205, a value twice a remainder obtained by dividing the tempo clock TCLK by 4 is stored in the bit register BIT. As described above, since the chord pattern data is 2-bit data, and sets of four 2-bit data (one byte) are stored in the pattern memory. In the processing in steps 204 and 205, the pointer ADRS and BIT are set at a chord pattern position (FIG. 5A) at the timing TCLK.

In step 206, a chord pattern to be read out is selected based on the rhythm number RHY, the variation number VAR, and the chord group GRP, and the selected number is stored in the register PAT. In step 207, the CPU 20 reads out the chord pattern data stored at two bits, i.e., bits (BIT+1) and BIT, of the storage position designated by the address ADRS of the chord pattern in the pattern memory 30, and stores in readout data in the register DT. Thereafter, the CPU 20 checks in step 208 if the stored pattern is equal to the chord pattern data ODT which is read out during the immediately preceding interruption processing. If these data are equal to each other, since no key event (a change in chord tone generation state) is made, the tempo clock TCLK is incremented by one within circulating values of 0 to 31 in step 210, and interruption is canceled. The control then recovers the main routine.

If the CPU 20 determines in step 208 that the new pattern data DT is different from the old chord pattern data ODT, the flow advances to step 211, and updates the register ODT using the new data DT. The CPU 20 checks in step 212 if the new data is "0".

As shown in the table in FIG. 5C, if the old data ODT is "00" and the new data DT is other than "00", the present timing corresponds to a key-on event generation (chord tone generation start) timing. If the old data ODT is other than "00" and the new data DT is "00", the present timing corresponds to a key-off event generation (chord tone generation end) timing.

Therefore, if the new data DT is "00", the present timing is a keys-off timing. In this case, in step 213, the CPU 20 keys off the chord tone. Thereafter, the tempo clock TCLK is incremented within the circulating values of 0 to 31 in step 210, and interruption is canceled. The control then recovers the main routine.

On the other hand, if the CPU 20 determines in step 212 that the new data is other than "00", the present timing is a key-on timing. In this case, the CPU 20 checks in step 220 if the key-on event is a key-on event with interval shift information.

If the new data is "11 (=3)", the key-on event is a key-on event with interval shift information. If the new data is "01 (=1)" or "10 (=2)", the key-on event is a key-on event without interval shift information. If the CPU 20 determines in step 220 that the new data DT is other than "11 (=3)", i.e., represents a key-on event without interval shift information, the CPU 20 executes chord tone generation processing in step 250 (to be described later). In step 210, the tempo clock is incremented within the circulating values of 0 to 31, and interruption is canceled. The control then recovers the main routine.

On the other hand, if the CPU 20 determines in step 220 that the new data DT is "11 (=3)", i.e., represents a key-on event with interval shift information, the flow advances to step 221. In step 221, the CPU 20 saves the root ROOT data, the chord type TYPE data, and the chord group GRP data. The CPU 20 refers to the chord conversion table in the table group 32 shown in FIG. 6A in steps 222 and 223 so as to obtain shift amounts of the root and chord group based on the rhythm number RHY, the variation number VAR, and group number GRP, and stores the obtained shift amounts in the corresponding registers RTCHG and GRPCHG. The following relations represent the processing in steps 222 and 223.

$CHDCNV(RHY,VAR,GRP)_R$
$\rightarrow RTCHG$
$CHDCNV(RHY,VAR,GRP)_G$
$\rightarrow GRPCHG$ In step 224, the CPU 20 checks the data RTCHG and GRPCHG. If both the shift amounts RTCHG and GRPCHG are "0", this means that no interval shift is performed. In this case, the flow advances from step 224 to step 250, and chord tone generation processing in step 250 and tempo clock increment processing in step 210 are executed. Thereafter, interruption is canceled, and the control recovers the main routine.

If the CPU 20 determines in step 224 that at least one of the data RTCHG and GRPCHG is not "0", the flow advances to step 225. In steps 225 and 226, as described above, the root and chord group are shifted in accordance with the data RTCHG and GRPCHG, and the shifted data are respectively stored in the registers ROOT and GRP. The root (note) data is numerical data varying between 0 and 11. Thus, in step 225, data obtained by adding the shift amount is divided by 12 to obtain its remainder, thereby converting to the root data varying between 0 and 11. The chord group data is similarly obtained by calculating a remainder as a result of a division by 3, thus obtaining data varying between 0 and 2.

After the processing in steps 225 and 226, the CPU 20 stores the chord group GRP in the register TYPE as the interval-converted chord type. In step 250, the chord tone generation subroutine processing is executed. In step 228, the CPU 20 reads out the root, chord type, and chord group data saved in step 221, stores them in the corresponding registers ROOT, TYPE, and GRP, and executes tempo clock increment processing in step 210. Thereafter, interruption is canceled, and the control recovers the main routine.

3. Chord Tone Generation Processing

In the electronic musical instrument shown in FIG. 1, the CPU 20 executes the tempo clock interruption processing for every 1/32 cycle of one measure during the automatic accompaniment operation. When the CPU 20 detects the key-on timing in step 212 in the interruption processing, it executes chord tone generation processing shown in FIG. 11 based on data of a chord designated at the keyboard or chord data obtained by converting the designated chord in accordance with interval shift information read out from the pattern memory 30 together with a chord pattern.

Referring to FIG. 11, the CPU 20 checks in step 251 if a chord is formed by key depression at the keyboard. The chord types TYPE "0" to "6" represent types of chord, and "7" represents that the chord cannot be formed.

If the CPU 20 determines in step 251 that the chord is formed, i.e., that the chord type TYPE is other than "7", the CPU 20 forms note data of three constituting tones of the chord specified by the root data ROOT and the chord type data TYPE based on a tone generation rule shown in FIG. 12, and stores the note data in the chord tone key code registers $KY_1$ to $KY_3$. On the other hand, if the chord cannot be formed (TYPE=7), the flow advances from step 251 to step 253, and the CPU 20 picks up three notes from among the highest tone of the key-on tones at the keyboard and stores the picked-up tones in the registers $KY_1$ to $KY_3$.

After the processing in step 252 or 253, the flow advances to step 254. In step 254, the CPU 20 converts note data stored in the registers $KY_1$ to $KY_3$ into key codes of corresponding notes within the range of $G_2$ to $F\#_3$. In step 255, if the key-on data of three key codes stored in the registers $KY_1$ to $KY_3$ and the chord pattern data represent key-on events with an accent, the CPU 20 executes chord tone key-on processing, e.g., sends data of a message indicating this to the tone generator 60, and so on. The control returns to the previous processing (step 210 or 228 in FIG. 10).

In the above description, the chord tone generation range is limited to a one-octave range starting from $G_2$ ($G_2$ to $F\#_3$), so that a natural chord performance can be made without notes having a large pitch difference in the electronic musical instrument shown in FIG. 1.

The present invention is not limited to the above embodiment, and various changes and modifications may be made within the spirit and scope of the invention.

1. A melody key range can be added.

2. The apparatus for performing an accompaniment in quadruple time at a thirty-second note resolution has been described. However, the resolution and time of the tempo clock are not limited to those in the above embodiment. Other resolutions and times may be set.

3. In the above description, one kind of interval shift information is employed. A plurality of kinds of interval shift information may be given.

4. In the above description, interval conversion is performed depending on rhythms (including variation patterns). However, predetermined conversion may be performed regardless of rhythm.

5. In the above description, control, e.g., interval conversion is performed in units of chords. However, the control can be made in units of individual constituting tones.

6. Key-on tones need not be produced.

7. The chord designation means may employ either a finger mode for depressing keys corresponding to constituting tones of a chord or a single finger mode for designating a chord using the root of the chord and other white or black key.

What is claimed is:

1. An automatic accompaniment apparatus for an electronic musical instrument, comprising:

pattern storage means for storing accompaniment pattern information including a tone generation timing of a chord;

means for storing interval shift information representing a manner in which intervals of respective constituting tones of a chord are to be shifted;

clock generation means for generating a clock signal;

readout control means for sequentially reading out the accompaniment pattern information from said pattern storage means in accordance with said clock signal generated by said clock generation means;

chord designation means for designating a chord in accordance with an operation of said chord designation means by a player;

interval conversion means for shifting intervals of the respective constituting tones of a chord designated by said chord designation means in accordance with the interval shift information to generate chord data representative of a chord different from said designated chord; and tone generation means for generating tones based on chord data outputted from said interval conversion means in accordance with the tone generation timing.

2. An automatic accompaniment apparatus according to claim 1, wherein said interval conversion means converts the chord designated by said chord designation means into a chord of another type.

3. An automatic accompaniment apparatus according to claim 1, further comprising rhythm selection means for designating a rhythm type, wherein said interval conversion means switches an interval conversion state in accordance with a rhythm type selected by said rhythm selection means.

* * * * *